United States Patent [19]

Nakagawa et al.

[11] Patent Number: 4,873,514

[45] Date of Patent: Oct. 10, 1989

[54] VIDEO DISPLAY SYSTEM FOR SCROLLING TEXT IN SELECTED PORTIONS OF A DISPLAY

[75] Inventors: Banri Nakagawa, Yamato; Katsuyuki Nojima, Yokohama, both of Japan

[73] Assignee: International Business Machines Corporation, Armonk, N.Y.

[21] Appl. No.: 809,993

[22] Filed: Dec. 17, 1985

[30] Foreign Application Priority Data

Dec. 20, 1984 [JP] Japan ..... 59-267639

[51] Int. Cl.[4] ..... G09G 1/16

[52] U.S. Cl. ..... 340/726; 340/724; 340/728

[58] Field of Search ..... 340/726, 721, 723, 724, 340/717, 728

[56] References Cited

U.S. PATENT DOCUMENTS

| | | | |
|---|---|---|---|
| 3,643,252 | 2/1972 | Roberts, Jr. | 340/726 |
| 3,792,462 | 2/1974 | Casey et al. | 340/726 |
| 4,204,206 | 5/1980 | Bakula et al. | 340/721 |
| 4,412,294 | 10/1983 | Watts et al. | 340/726 |
| 4,418,344 | 11/1983 | Brown | 340/726 |
| 4,437,093 | 3/1984 | Bradley | 340/724 |
| 4,489,317 | 12/1984 | Shiga | 340/726 |
| 4,520,356 | 5/1985 | O'Keefe et al. | 340/717 |
| 4,663,617 | 5/1987 | Stockwell | 340/726 |

*Primary Examiner*—Donald J. Yusko
*Assistant Examiner*—M. Fatah-yar
*Attorney, Agent, or Firm*—Mark S. Walker; J. Dennis Moore; Frederick D. Poag

[57] ABSTRACT

In a CRT display system, its screen is divided into a least two partitions or viewports for displaying different data groups, and characters in one of the groups can be vertically scrolled bit by bit in one of the partitions. The partition to be scrolled is defined by line attributes assigned to successive rows of the screen. When a raster scan passes the scrolling partition, a line count output of a (scan) line counter is modified by adding a content of a smooth scroll offset register to the line count. The modified line count is used together with a character code as an address for a character generator. By gradually changing the content of the offset register, the characters are vertically shifted smoothly in the partition.

6 Claims, 7 Drawing Sheets

VIDEO DISPLAY SYSTEM FOR SCROLLING TEXT IN SELECTED PORTIONS OF A DISPLAY

BACKGROUND OF THE INVENTION

1. Field of the Invention

This invention relates to a display apparatus having a function of vertical smooth scrolling in a part of the area of a CRT screen.

2. Prior Art

Heretofore, a method for displaying different data groups (such as characters) on a plurality of divided areas on the screen in a CRT display device has been known. Japanese Published Unexamined Patent Application No. 54-105435 discloses a display device having a partial vertical scrolling function to shift characters vertically only in specific areas while keeping characters still in other areas. However, the shifting unit on scrolling is a character line, and the smooth scrolling function to shift characters by the unit of dot is not provided.

On the other hand, the display control method disclosed in Japanese Published Unexamined Patent Application No. 49-90459 establishes static and dynamic areas on a screen, and shifts characters by the unit of dot within the dynamic area. The possibility of shifting not only in the horizontal direction but also in the vertical direction is suggested. However, these two types of areas are fixed and cannot be established flexibly, and two separate memories are required to be assigned to the two areas. In Japanese Published Unexamined Patent Application No. 58-207077, a display device for performing the vertical smooth scrolling by sequentially changing the content of a current raster counter to control read out of the character generator is disclosed. However, this device shifts characters in the whole area of the screen, and has no function to shift only characters in a specific area.

PROBLEMS TO BE SOLVED BY THE INVENTION

As described above, prior art has been known to enable vertical smooth scrolling only in a part of the screen, but the establishment of areas and the assignment of memories are fixed and there is no flexibility.

SUMMARY OF THE INVENTION

The display apparatus of this invention has a means for holding control information to define a display column range and a display row range of an area on a screen subjected to the vertical smooth scrolling and a means for holding offset data indicating a vertical shift amount of the vertical smooth scrolling, and the control information and offset data can be changed suitably by a control means. It is also provided with a means for generating a smooth scroll area signal based on said control information and a means for modifying a line count output of a line counter in synchronism with the scanning of the screen during the generation of the smooth scroll area signal. Thus, in the scroll area, the modified line count output cooperated with a character code to read a series of bits corresponding to a horizontal part of a corresponding character pattern out of a character generator and supply it to the CRT display circuit.

Further, in an address device for reading the character code out of a storage device, a row counter for the scroll area and a row counter for the other area are provided to enable the reading of character codes to be displayed on display rows indicated by row counts of these row counters.

Figure 6:
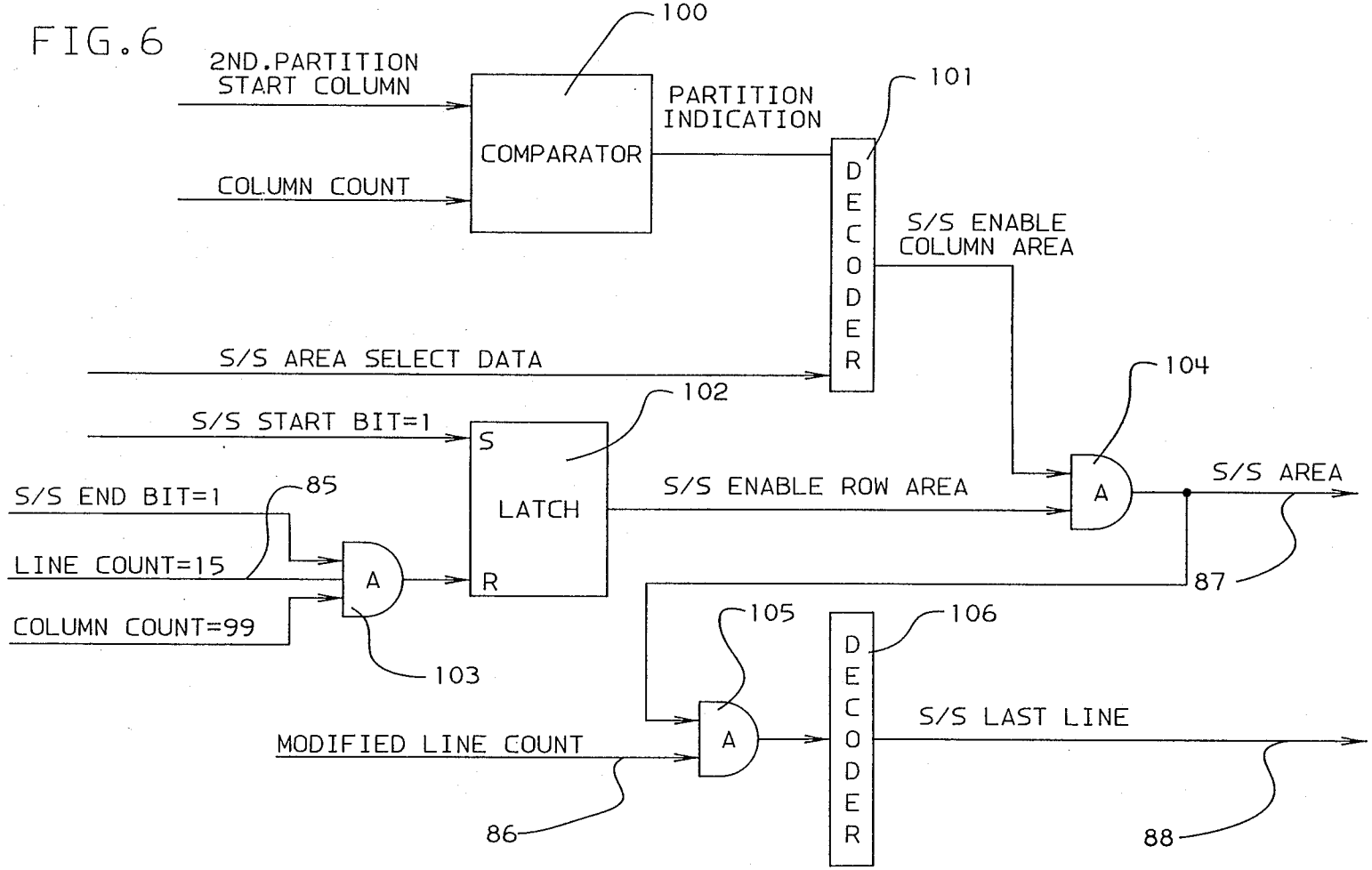
Figure 7:
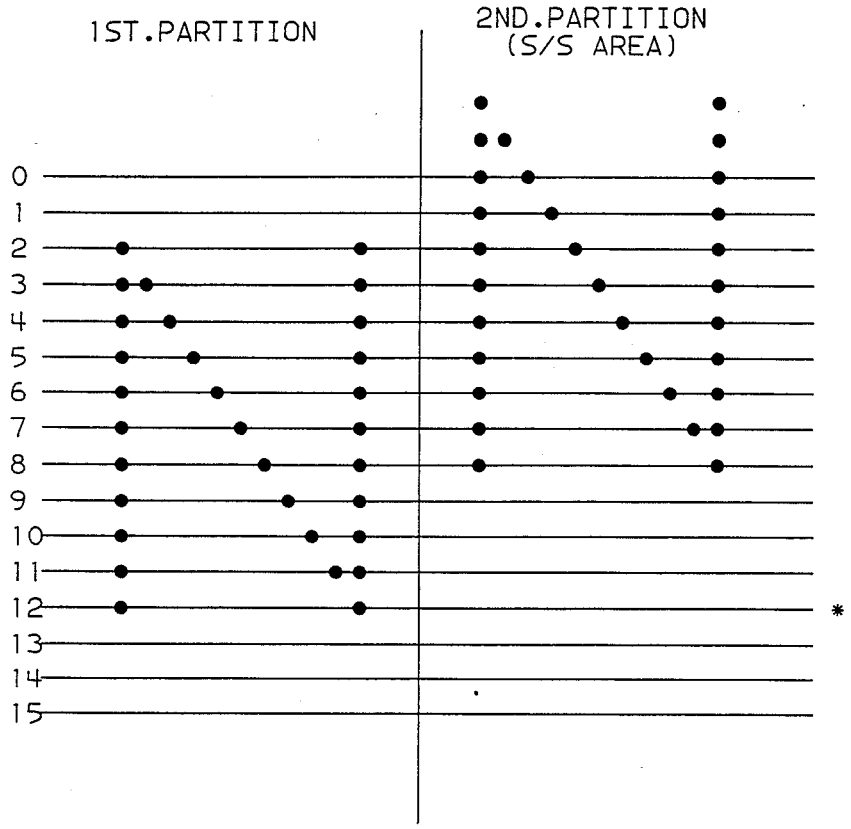

FIGS. *5a–5d* are diagrams showing various smooth scroll areas established on the screen;

FIG. 6 is a diagram showing the main configuration of the controller 71; and FIG. 7 is a diagram showing an example of relation between display locations of a character in the first and second partitions.

PREFERRED EMBODIMENT

Figure 1A:
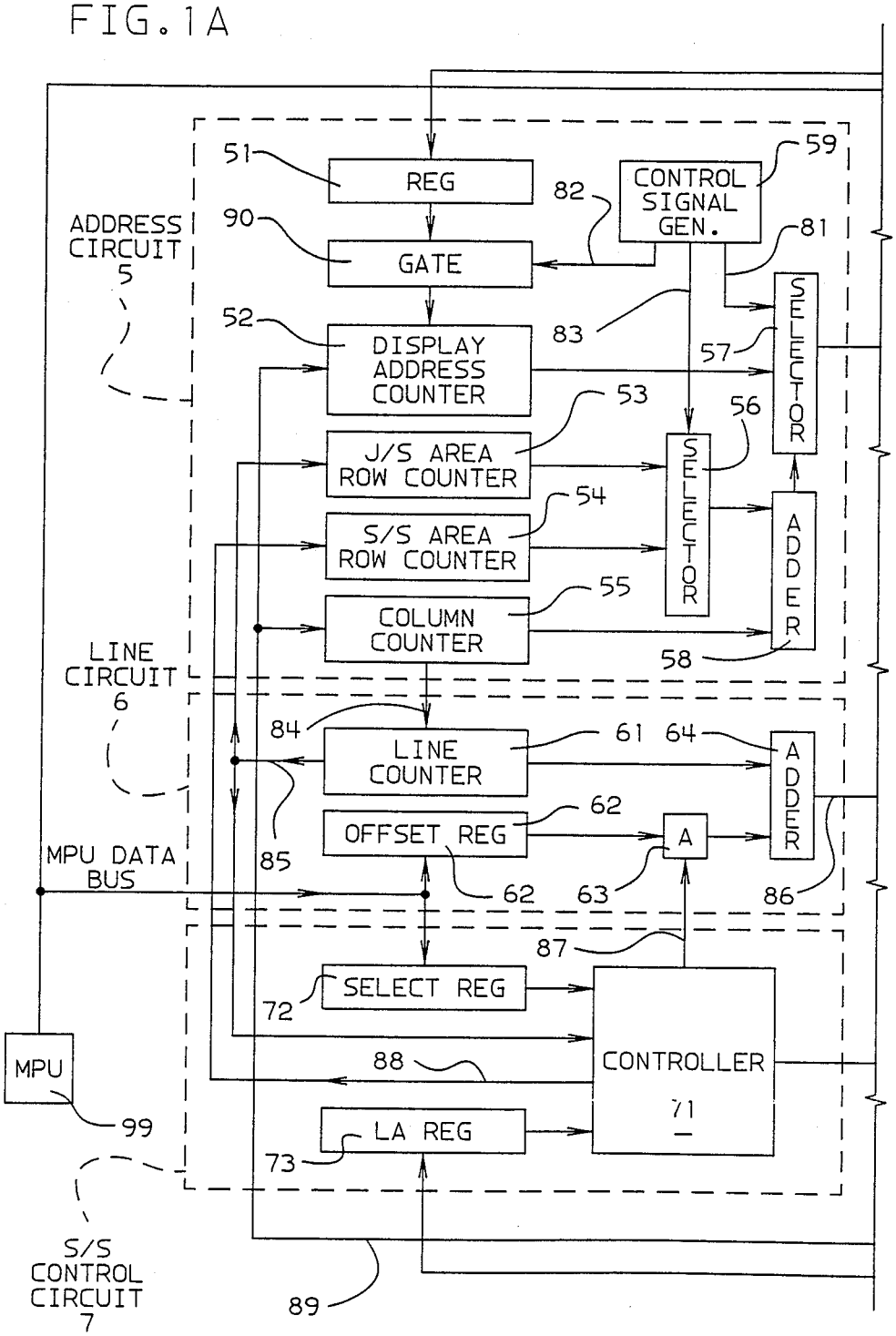
FIG. 1 is a block diagram showing a display apparatus according to this invention.
Figure 1B:
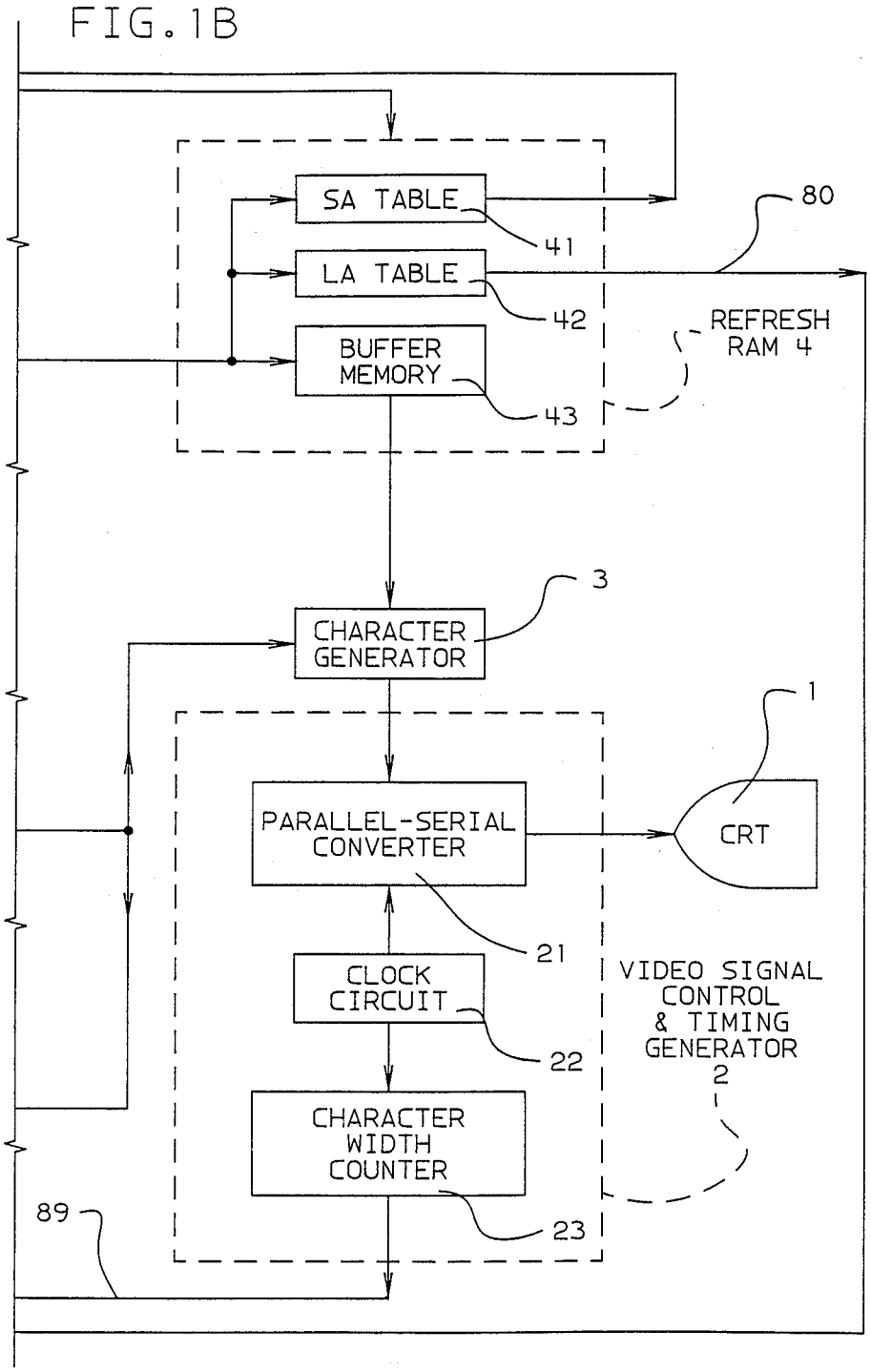

FIG. 1 shows the configuration of an embodiment of the display apparatus according to this invention. As shown in FIG. 1, this display apparatus comprises a CRT 1, a video signal control and timing circuit 2, a character generator 3, a refresh RAM 4, an address circuit 5, a line count circuit 6, a smooth scroll (S/S) control circuit 7 and a microprocessor (MPU) 99. The microprocessor 99 performs overall control for display such as the arrangement of data to be displayed. The CRT 1 has a screen to display characters (including symbols) of, for example, 24 rows×80 columns.

Figure 2:
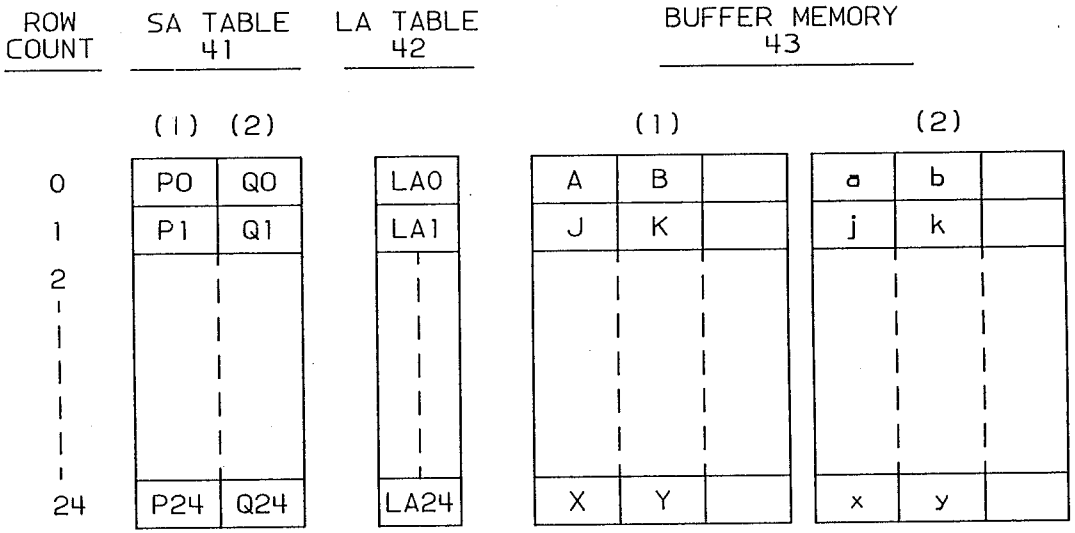
FIG. 2 is a diagram showing relation between the SA table 41, LA table 42 and buffer memory 43 in FIG. 1.

The refresh RAM 4 consists of a start address (SA) table 41, a line attribute (LA) table 42 and a buffer memory 43, and store various information written by the MPU 99 at need. Referring to FIG. 2, the relation between the information stored in the SA table 41, LA table 42, and buffer memory 43 will be described. In FIG. 2, examples of the contents of the tables and memory are shown in relation to 25 rows identified by row counts from 0 to 24. The reasons why data for 25 rows is required for 24 display rows defined on the screen is that it is necessary on scrolling to display partially data for an additional row. The buffer memory 43 stores a plurality of character codes indicating characters to be displayed. In this embodiment, characters corresponding to codes A, B . . . shown in portion (1) of the buffer memory 43 are displayed in the first row of the screen, and those corresponding to J, K . . . are displayed in the second row. When the displaying is performed on the left and right areas of the screen, i.e. the first partition and the second partition, if characters corresponding to codes in the portion (1) are displayed on the first partition, for example, while codes a, b, . . . j, k in the portion (2) are displayed on the second partition.

The LA table 42 stores line attributes LA0, LA1 . . . LA24 assigned to each row as information to control the display pattern of each row. Line attributes also contain control information for the vertical smooth scrolling. The details will be described later.

The SA table 41 consists of a portion (1) for the first partition and a portion (2) for the second partition. Each portion stores addresses of storage locations in the buffer memory 43 which stores the codes of the characters to be displayed at the starts of successive rows in each partition. This address is called the start address.

Start addresses P0, P1 . . . P24 are addresses of storage locations for codes A, J . . . X in the buffer memory 32, and start addresses Q0, Q1 . . . Q24 are addresses of storage locations for codes a, j . . . x. As described later in detail, the start address is transmitted to a display address counter 52 through a register 51 and a gate 90 in the address circuit 5, and used for reading a code out of the buffer memory 43.

The read code is transmitted to the character generator 3. The character generator also receives a line count generated by the line count circuit 6 on a line 86 at the same time, and as is well known, supplies a plurality of bits corresponding to a horizontal part of a character pattern to a parallel-serial converter 2 in the circuit 2 in parallel. For example, if the character pattern consists of 16×8 bits (dots), 8 bits corresponding to the line count are taken out. The parallel-serial converter 21 transmits the 8 bits to the CRT 1 serially in synchronism with a clock signal generated by a clock circuit 22 to display them on a certain scanning line. The clock signal is also supplied to a character width counter 23. This counter divides the frequency of the clock signal indicating the display timing of successive characters at the line 89. The video signal control and timing circuit 2 and the character generator 3 containing such entities are well known.

Next, the details of the address circuit 5 will be described. As is shown in FIG. 1, this circuit comprises a start address register 51, a display address counter 52, a jump scroll (J/S) area now counter 53, a smooth scroll (S/S) area row counter 54, a column counter 55, selectors 56 and 57, an adder 58 and a control signal generator 59. The selector 57 gates either one of outputs of the display address counter 52 or the adder 58 selectively depending on control signals on the line 81. Similarly, the selector 56 gates either one of outputs of the J/S area row counter 53 and the S/S area row counter 54 selectively depending on control signals on the line 83. The details of generation of control signals on lines 81 and 83, and the operation timing of selectors 56 and 57 will be described later.

The column counter 55 indicates the column counts determining the display time of successive characters and display locations on the screen in accordance with the character clock signal generated by the character width counter 23 on the line 89. In this embodiment, the column counter 55 operates so as to repeat column counts from 0 to 99. Column counts from 0 to 79 correspond to the display range in the horizontal direction; column counts 80 to 99 correspond to the display prohibition range (horizontal retrace time) in the horizontal direction of the CRT 1. The column counter 55 generates a pulse on a line 84 each time the column count reaches 99, thereby incrementing a line counter 61 in the line count circuit 6. The line counter 61 indicates line counts from 0 to 15 (corresponding to 16 scanning lines) for each display row, and generates a signal on the line 85 to become a high level each time the line count reaches 15. This signal is supplied to the J/S area row counter 53 and a controller 71 in the S/S control circuit 7.

The J/S area row counter 53 counts each time the signal on the line 85 changes from a high level to a low level and generates row counts from 0 to 26 repeatedly. Row counts 0 to 23 correspond to 1st and 24th display lines of the vertical display range; row counts 24 to 26 correspond to the display prohibition range (vertical retrace time) in the vertical direction. The J/S area row counter 53 is used when the displaying is performed on the left and right partitions of the screen to indicate row counts for the partition not subjected to the smooth scrolling. On the other hand, the S/S area row counter 54 is used to indicate row counts for the partition subjected to the smooth scrolling. For this purpose, the S/S area row counter 54 does not count in accordance with the signal generated by the line counter 61 on the line 85, but counts in accordance with a signal generated by the controller 71 in the S/S control circuit 7 on the line 88, as described later.

The reason why the S/S area row counter 54 is used besides the J/S area row counter 53 is that, in the scroll partition, a row count different from that for the non-scroll partition is required because a boundary between adjacent rows may appear on a certain scanning line other than the first and last scanning lines of a display row.

The row count of the J/S area row counter 53 or the S/S area row counter 54 selected by the selector 56 and the column count of the column counter 55 are added by the adder 58 to be used as the address for taking out the start address from the SA table 41 (see FIG. 2) and as the address for taking out the line attribute from the LA table 42. When the screen is divided into two partitions, the start addres (P0, P1 etc.) for the first partition is loaded in the display address counter 52 through the register 51, then the start address Q (Q0, Q1 etc.) for the second partition is loaded in the register 51. Thus, it is ready to transfer Q from the register 51 to the display address counter 52 when passing out of the first partition to the second partition.

Figure 4:
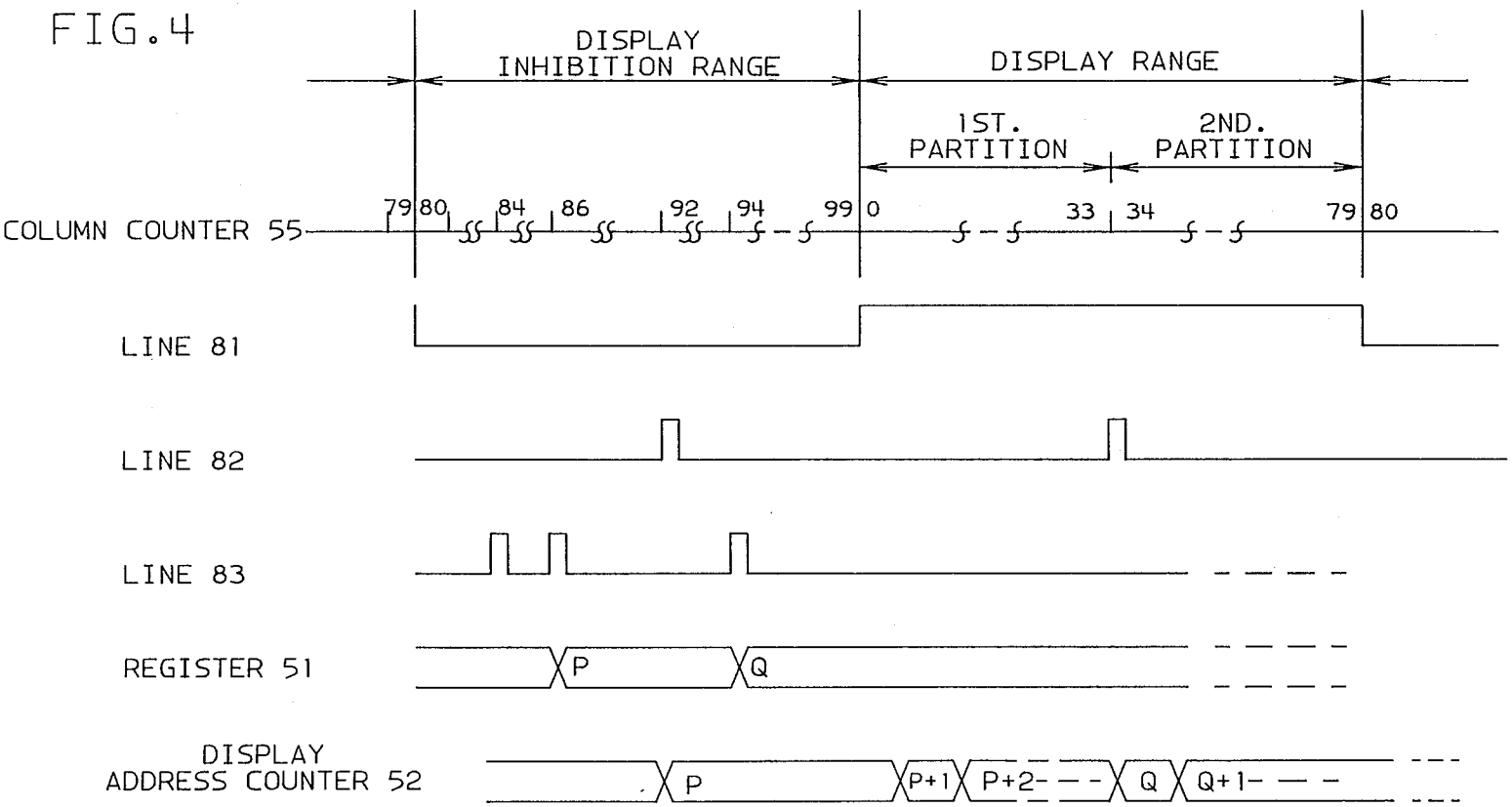
FIG. 4 is a diagram showing the operation timing mainly of the address circuit 5.

Referring now to FIGS. 1 and 4, the operation timing of the address circuit 5 will be described. In FIG. 4 is shown an example in which the screen is divided at the boundary of column counts 33 and 34, and the vertical smooth scrolling is allowed in the second partition. The control signal generator 59 is connected to the column counter 55 and the S/S control circuit 7 (in FIG. 1, the connecting lines are omitted), and generates the control signals on lines 81, 82 and 83 based on the signals from them. The signal on the line 81 is a simple signal which is of a high level when the column counts are from 0 to 79 (indicating the horizontal display range), and of a low level when the column counts are from 80 to 99 (indicating the horizontal display prohibition range). This signal controls the selector 57 so as to select the output of the display address counter 52 when the level is high, and the output of the adder 58 when the level is low.

The signals on the line 83 to control the selector 56 are signals $\alpha$, $\beta$ and $\gamma$ generated in the timing shown in FIG. 4. These signals are not as simple as those having only high and low levels. First, the signal $\alpha$ instructs the selection of output of the J/S area row counter 53. Consequently, the row count of the J/S area row counter 53 and the column count of the column counter 55 are added by the adder 58. The added output is used as the address for the LA table 42 through the selector 57, and the line attribute (LA) selected is transferred to the LA register 73 of the S/S control circuit 7 through a line 80. In this embodiment, since the first partition is the area not subjected to smooth scrolling, the signal $\beta$ also instructs the selection of the J/S area row counter 53. The output of the adder 58 in this time is used as the address to take out the start address P (e.g. P0) from the portion for the first partition in the SA table 41. The start address is loaded to the register 51, and when the control signal is generated on the line 82, it is transferred to the address counter 52 through the gate 90. The signal $\gamma$ instructs the selection of the S/S area row counter 54, and the output of the adder 58 in this time is used as the address to take out the start address Q (e.g. Q0) from the portion for the second partition of the SA table 41. The start address Q is loaded to the register 51, and held there until the signal on the line 82 becomes high when the displaying on the second partition is started.

The display counter 52 counts sequentially from P (P0) to P+1, P+2 . . . in the first partition, and from Q (Q0) to Q+1, Q+2 . . . in the second partition, and indicates addresses to fetch character codes from the buffer memory 43.

Figure 3:
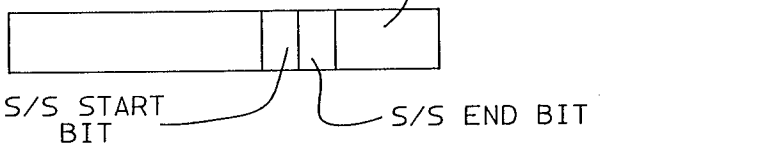
FIG. 3 is a diagram showing the format of line attributes.

Next, the configuration of the S/S control circuit 7 will be described. The S/S control circuit 7 comprises a select register 72 and a line attribute (LA) register 73 in addition to the controller 71. In the LA register 73, as described above, the line attribute taken out from the LA table 42 is loaded. The line attribute has a format schematically shown in FIG. 3. The S/S start bit is set to "1" only for the line attribute corresponding to the display row from which the smooth scrolling is started, and to "0" for other line attributes. The S/S end bit is set to "1" only for the line attribute corresponding to the display row at which the smooth scrolling ends, and to "0" for other line attributes. The second partition start column data indicates the starting column of the second partition when the screen is divided vertically. The remaining information contained in the line attribute is used for other control which is not related to the smooth scrolling. An S/S area select data indicating which partition of the two is subjected to smooth scrolling is loaded from the MPU 99 to the select register 72 through the data bus. Although the register 72 is used in this embodiment, it is possible to adopt a technique to use the line attribute containing the S/S area select data.

Figure 5:
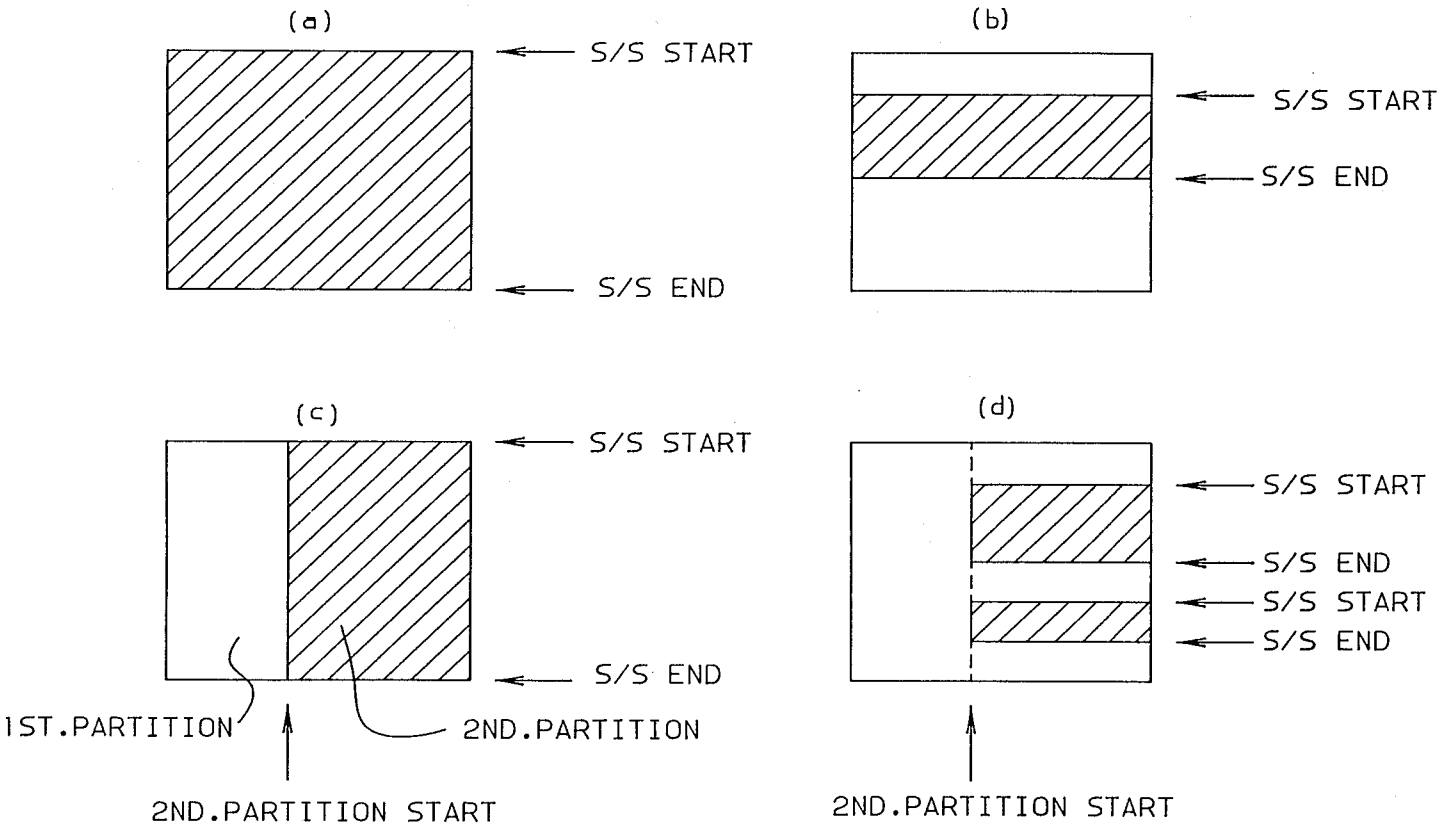

FIG. 5 shows the smooth scroll (S/S) area which can be established on the screen of the CRT 1 in accordance with the content of the select register 72 and the LA register 73. The hatched areas are S/S areas. Examples (a) and (b) illustrate to the execute smooth scrolling on the whole screen and only within a specific row range, respectively, without dividing the screen. Examples (c) and (d) illustrate to establish two partitions and execute the smooth scrolling only in the second partition. As seen from the example (d), a plurality of S/S areas can be established by controlling S/S start bits and S/S end bits.

The controller 71 has a configuration as schematically shown in FIG. 6 to generate an S/S area signal on a line 87 and an S/S last line signal on a line 88 for the control of smooth scrolling. A comparator 100 generates a partition indication signal to indicate whether the scanning lines on the screen of the CRT1 are present in the first partition or the second partition by comparing the second partition start column indicated by the line attribute in the LA register 73 with the column count indicated by the column counter 55. A decoder 101 generates an S/S enable column area signal in accordance with the partition indication signal and the S/S area select data from the select register 72. An S/S enable column area signal is of a high level only within the column direction range enabling the smooth scrolling. A latch 102 is set when the S/S start bit of the line attribute is 1, and is reset by an output of an AND gate 103 when the S/S end bit is 1, the line count is 15, and the column count is 99. Thus, the S/S enable signal from the latch 102 becomes high only within the line direction range enabling the smooth scrolling. An AND gate 104 generates the S/S area signal on the line 87 which becomes high only both two inputs are high. Eventually, the S/S area signal indicates the time when the scanning lines are in the hatched areas of the screen shown in FIG. 5.

An AND gate 105 gates the line count on the line 86 when the S/S area signal is of a high level. As described later, this line count is the one generated by the line counter 61 in the line count circuit 6 and modified by an adder 64. Of course, in a certain case, the line count of the line counter 61 is passed as it is depending on the condition of the second input of the adder 64. A decoder 106 generates an S/S last line signal on the a 88 when the line count supplied through the AND gate 105 is at 15. This signal is used for incrementing the S/S area row counter 54 described above.

In the offset register 62 in the line count circuit 6, the offset data to control the vertical smooth scrolling is loaded. The MPU 99 operates so as to change this offset data adequately. The offset data is transmitted to the adder 64 through the AND gate 63 when the level of the S/S area signal generated by the controller 71 on the line 87 is high, and added to the line count of the line counter 61. Eventually, paying attention to a certain scanning line, the line count of the line counter 61 appears as it is on the line 68 outside the scroll area, whereas the line count to which the offset data is added appears within the scroll area.

FIG. 7 shows the relation between 16 scanning lines in a certain row and characters displayed when the second partition is the S/S area and the offset data is assumed to indicate 4. It is also assumed that the same character N is displayed in both partitions. As seen from this, since the sum of 4 and the line count indicated by the line counter 61 is used as the (modified) line count in the S/S area, deviated horizontal parts are sequentially taken out from the character generator 3, whereby the display as shown in FIG. 7 is obtained. In the horizontal scroll area, the upper part of the character N is displayed in an upper adjacent row, and in the section below the scanning line indicated by * (line count=12, or, corrected line count=0), the character which is present in a lower adjacent row is displayed.

Eventually, if the offset data is increased by 1 during the vertical retrace time at a suitable interval, the display in the S/S area is shifted by one line upward. On the contrary, if the offset data is decreased by 1, the display on the S/S area is shifted by one line downward. Thus vertical smooth scrolling can be achieved.

EFFECT OF THE INVENTION

According to this invention, various areas of vertical smooth scrolling can be established, and the area can be changed easily. Therefore, versatile display operations can be performed.

What is claimed is:

1. A display apparatus providing vertical smooth scrolling, having a storage device for storing a plurality of character codes for characters to be displayed on a screen of a CRT in connection with display rows, a column counter for generating a column count output indicating successive character display columns in synchronism with the horizontal scanning of said screen, a line counter for incrementing each time said column count output reaches a predetermined value to generate a line count output indicating successive scanning lines, address means for reading character codes successively out of said storage device in synchronism with said column counter and line counter, and a character generator for transmitting a sequence of bits corresponding to a horizontal part of a corresponding character pattern in accordance with each character code read out of said storage device and said line count output, said display apparatus comprising:

control information holding means for holding control information defining a display column range and a display row range of an area wherein the vertical smooth scrolling is to be provided in said screen, signal generator means connected to said control information holding means, a column counter and line counter for generating a smooth scroll area signal only during the time the area defined by said control information is scanned, offset data holding means for holding offset data indicating a vertical shift amount for the vertical smooth scrolling, modification means connected to said line counter, signal generator means and offset data holding means for modifying said line count output only during the generation of said smooth scroll area signal to provide a modified line count output, and control means which can adequately modify said offset data and said control information, wherein said address means comprises a first row counter for incrementing each time said line count output reaches a predetermined value, a second row counter for incrementing each time said modified line count output reaches a predetermined value, and a means connected to said control information holding means for instructing to read the character codes for the display row indicated by the row count of said second row counter within the display column range of the area subjected to the vertical smooth scrolling and for instructing to read the character codes for the display row indicated by the row count of said first row counter within the other display column range.

2. A display apparatus in accordance with claim 1, wherein said control information holding means comprises a table for storing line attributes including boundary information to define at least two areas in said screen, a line attribute register loadable with one of said line attributes and a select register loadable with information to designate one of said areas as a scroll area, and said addres means is also operable to select respective line attributes to be transferred from said table to said line attribute register in coordination with the scanning of said screen, said signal generating means being responsive to said information in said select and line attribute registers.

3. A display apparatus in accordance with claim 1, wherein said address means comprises a display address counter, a first row counter for identifying rows in said storage for non-scrolled display, a second row counter for identifying rows in said storage device for scrolled display, and a control signal generator responsive to said control signal generating means to select between said first and second counter for operation in conjunction with said address counter in the addressing of said storage device for fetching character codes therefrom.

4. A video display system for smooth scrolling of a selected partition of a display device comprising, in combination, a character generator operable to generate a horizontal slice of a character pattern on the display screen of a cathode ray tube in response to character and line count signals from a line counter which is synchronized with a raster scan of said cathode ray tube, the improvement characterized by first means for storing control information to indicate a partition to be scrolled on said display screen, second means connected to said first means for generating a scroll area signal when said partition is scanned, third means for retaining offset data, fourth means connected to the output of said line counter, second and third means, and responsive to said scroll area signal for selectively modifying said line count signal with said offset data, and control means for changing said offset data in said third means.

5. A video display system of the type defined in claim 4, further comprising a storage device for storing a plurality of character codes for display on said display screen in a plurality of display rows, a column counter having an output for indicating successive horizontal scanning of said screen, a line counter for incrementing each time said column count output reaches a predetermined value to generate a line count output indicating successive scanning lines, an address device for successively reading character codes from said storage device in synchronism with said column counter and said line counter, said video display system being characterized by a control information holding means for holding control information defining a display column range and a display row range of an area wherein smooth scrolling is to be performed on said screen, signal generating means connected to said control information holding means, said column counter and said line counter for generating a smooth scroll area signal during the time the area defined by said control information is scanned, an offset data holding means for holding offset data indicating a vertical shift amount for vertical smooth scrolling, modification means connected to said line counter, said signal generator means and said offset data holding means for modifying said line count output only during the generation of said smooth scroll area signal to modify said line count outputs, control means for modifying said offset data and said control information, wherein said address means comprises a first row counter incremented each time said line count output reaches a predetermined value, and a second row counter incremented each timee said corrected line count output reaches a predetermined value, and means connected to said control information holding means for providing readout of the character codes for the display row indicated by the row count of the boundary of the area subjected to the smooth scrolling and for providing readout of the character codes for the display row indicated by the row count of said first row counter within the display column boundary.

6. Display apparatus as defined in claim 5, wherein smooth scrolling can be performed in different areas of said screen by establishing the appropriate offset data and control information.

* * * * *